United States Patent [19]

Kriegeskorte

[11] Patent Number: 4,563,828

[45] Date of Patent: Jan. 14, 1986

[54] DETONATOR MECHANISM FOR CARTRIDGES, PARTICULARLY FOR CARTRIDGES USED IN MANUAL WEAPONS

[75] Inventor: Arndt Kriegeskorte, Aichtal-Aich, Fed. Rep. of Germany

[73] Assignee: Kriegeskorte & Co., GmbH, Stuttgart, Fed. Rep. of Germany

[21] Appl. No.: 563,086

[22] Filed: Dec. 19, 1983

[30] Foreign Application Priority Data

Dec. 21, 1982 [DE] Fed. Rep. of Germany ..... 3247211
Sep. 9, 1983 [DE] Fed. Rep. of Germany ..... 3332530

[51] Int. Cl.[4] ..... F41C 19/12; F42B 5/08

[52] U.S. Cl. ..... 42/84; 89/28.05; 89/135

[58] Field of Search ..... 89/135, 28.05; 42/84

[56] References Cited

U.S. PATENT DOCUMENTS

| | | | |
|---|---|---|---|
| 2,279,692 | 4/1942 | Marten-Gwilliam | 89/28.05 X |
| 3,495,349 | 2/1970 | Thompson | 42/84 |
| 3,650,174 | 3/1972 | Nelsen | 89/28.05 |
| 3,736,837 | 6/1973 | Kaprelian et al. | 89/28.05 |
| 4,332,098 | 6/1982 | Estenevy | 42/84 |

*Primary Examiner*—David H. Brown
*Attorney, Agent, or Firm*—Erwin S. Teltscher

[57] ABSTRACT

A detonator mechanism for use with cartridges normally actuatable by firing pin and having a casing which has at least a partial region which includes a floor portion. The housing contains detonating means which can be ignited above a predetermined detonating temperature. A portion of the weapon, which contains at least one of the cartridges, is electrically connected to the conductive region of the casing. A detonating current transfer device made of an electrically conductive material is movably supported with respect to the floor portion, and is arranged to establish contact with the floor portion. At least one rechargeable capacitor serves as a source of detonating current. The source of detonating current, the detonating current transfer device, the detonator, the casing, and the portion of the weapon form a series-connected circuit, and a switch is connected to the circuit. The detonating current is selected so that heat generated thereby in a transition resistance arising during contact between the floor portion and the detonating current transfer device is sufficient to heat the detonating means at least up to the detonating temperature.

12 Claims, 2 Drawing Figures

DETONATOR MECHANISM FOR CARTRIDGES, PARTICULARLY FOR CARTRIDGES USED IN MANUAL WEAPONS

BACKGROUND OF THE INVENTION

The invention relates to a detonator mechanism for cartridges, particularly cartridges for use in a manually actuable weapon. Such a cartridges includes a casing which has at least a partial region which is electrically conductive, a primer or detonator with an electrically conductive housing, and a detonator means in this housing. The detonator means can be ignited above a predetermined detonating temperature. A portion of the weapon, is adapted to contain at least one of the cartridges, and is electrically connected to the conductive region of the casing, a detonating current transfer device made of an electrically conductive material is movably supported with respect to the housing, and is arranged to make contact with the housing, and at least one rechargeable capacitor serves as a source of detonating current. The source of detonating current, the detonating current transfer device, the detonator, the casing, and the portion of the weapon form a series-connected circuit, and a switch is connected to the circuit.

Electrical detonators of this kind have an advantage over conventional detonating devices equipped with a firing pin, in as much as upon detonation either no oscillations, or at least no significant oscillations occur, which inevitably arise upon impact of the firing pin with the detonator. Consequently a significantly higher hit accuracy is attainable, compared to a mechanical detonating device. The known detonating mechanisms have, however, the disadvantage, that they can only be utilized in conjunction with special munitions, but not with conventional munitions, which are used in weapons equipped with percussion priming. This applies not only to high electric voltage detonator devices, but also to those detonating devices, which operate at a relatively low voltage. This is due to the fact that detonation is accomplished, for example, by heating of a resistance element imbeded in the detonating means, or by the fact that the detonating current is fed from a contact element, which is electrically insulated from, and disposed on the floor of the detonator housing, to the housing through the detonating means, or in a direction opposite thereto. In known detonating devices of the aforedescribed kind, not only is it necessary that the munition include a specially formed detonator, but the detonator must also include electrically conducting detonating means; this is not the case in conventional munitions detonated by means of a firing pin.

SUMMARY OF THE INVENTION

It is therefore a primary object of the invention to devise a detonating mechanism for cartridges, particularly cartridges used in manually operable weapons, which combines the advantages of the known mechanical detonator mechanisms with those of the known electrical detonator mechanisms, namely a mechanism which avoids any mechanical oscillations triggered by the detonating process almost completely, but which nevertheless permits the use of conventional munitions designed for use in conjunction with a percussion primer.

This object is attained by the detonating current transfer device of the electrically operable detonating mechanism being adapted to make a contact with the floor portion of the detonator housing for use with cartridges normally designed to be actuatable by a firing pin for the detonation thereof, and by selecting the detonating current so that heat generated thereby in the transfer resistance of the contact is sufficient to heat the detonating means at least up to the detonating temperature.

As no detonating impact is exerted on the detonator, according to the inventive detonating mechanism, but wherein detonation is rather accomplished electrically, the detonating process does not trigger any movements or oscillations of the weapon, which could impair its hit accuracy. On the other hand, cartridges of conventional construction can be used without any limitation, due to the fact that detonation is accomplished by heating of the detonating means, as a result of dissipated heat in the transfer resistor of the contact between the floor portion of the detonator housing, and the detonating current transfer means.

Due to the relatively large detonating current it is furthermore advantageous to implement the switch connected within the detonating current circuit as a semiconductor switch, preferably as a thyristor.

In order to attain the detonating temperature at as low a detonating current as possible, in a preferred embodiment the detonating current transfer means is implemented as a rod arranged to contact the floor of the detonator housing by means of an ignition tip, which has a diameter ranging between 0.5 mm to 1.5 mm. A diameter of 1.3 mm has been shown to be especially advantageous in several applications. By matching in such a manner the size of the surface of the detonating current transfer means making contact with the floor portion of the detonator housing, it is possible to achieve optimum conditions in the region of the transfer resistor; it is the transfer resistor which determines the heat losses generated thereat, the magnitude of which is in turn determining the heating of the detonating means. Furthermore, selection of the detonating voltage must also be taken into account, which must be chosen so as to obtain, on one hand, as rapid a heating of the detonating means as possible, but on the other hand the floor portion of the detonator housing must not be burned through.

At least the end region of the detonating current transfer means arranged to contact the floor portion of the detonator housing should be made of a tough and fire-resistant material, so as to ensure a sufficiently long life span, and consequently an adequately large number of shots. Materials which satisify these requirements include, amongst others, for example, pure steel, pure iron, tungsten, tantalum or copper-tungsten.

In a preferred embodiment the contact pressure which is exerted by the detonating current transfer means onto the floor portion of the detonator housing lies in the range between 2 g and 20 g. The magnitude of the optimal pressure does not only depend on the size of the contact surface, but also on the material from which the ignition tip of the detonating current transfer means consists.

As a material migration cannot, as a rule, be prevented when the ignition tip and the floor portion of the detonator housing are heated, and as material losses of the ignition tip should be minimized in the interest of as large as possible a life span, it is advantageous to so select the polarity of the detonating current, that a material migration takes place from the detonator housing, usually made of brass, toward the ignition tip. Such deposition of material on the ignition tip is not disturbing, as it is usually again torn off therefrom, when the cartridge shell is ejected, because the deposited material is normally welded to the floor portion of the detonator housing.

In view of the desireablity to attain a long life span, it is furthermore advantageous to use a very hard material for the insulating means inserted into the breech block of the weapon, and wherein the insulating means insulates the detonating current transfer means with respect to the metallic portions of the breech block. In a preferred embodiment such insulating means is therefore selected to be either ceramic material or corundum.

BRIEF DESCRIPTION OF THE DRAWINGS

The invention will now be described in further detail by means of the embodiment examples in the drawing, wherein.

DESCRIPTION OF THE PREFERRED EMBODIMENT

Figure 1:
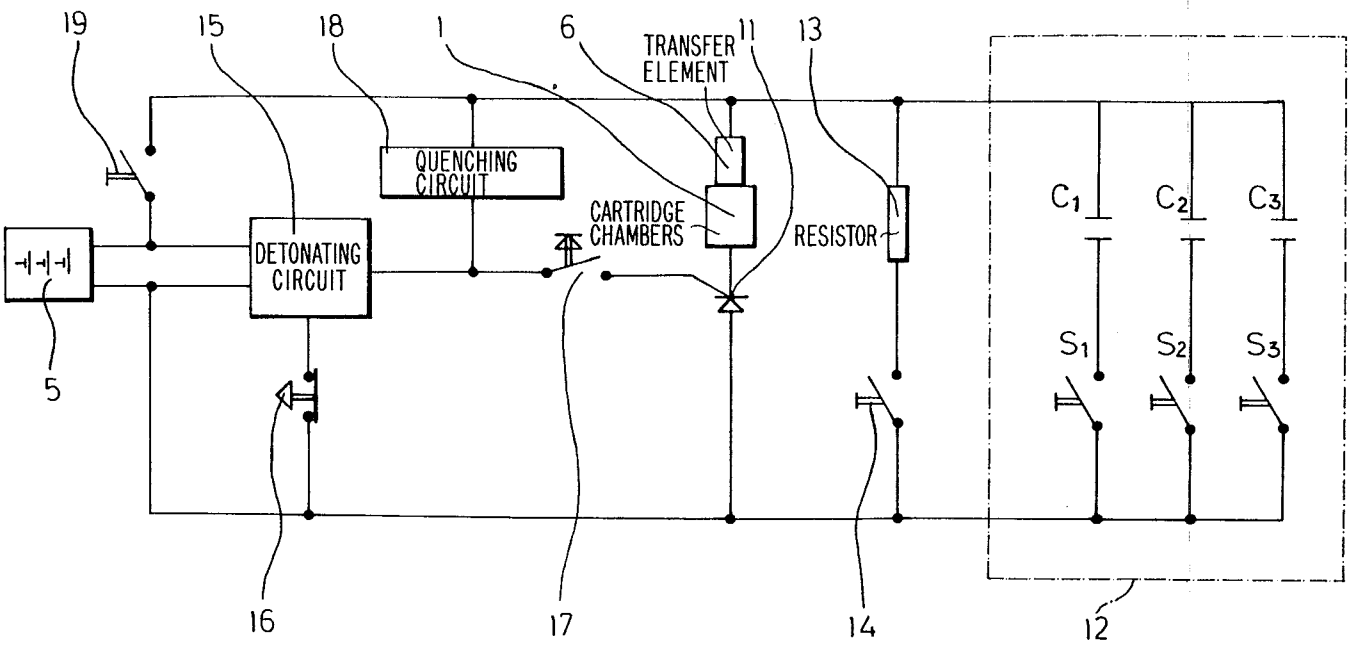
FIG. 1 is block circuit diagram of the embodiment example.

Referring now to the drawing, an electrical detonating mechanism for a cartridge of a conventional construction disposed in a cartridge chamber 1 of a rifle includes as detonating voltage source a battery 5, which in the embodiment example has a voltage of 36 Volts. The cartridge includes a metallic cartridge casing 2, and a percussion cap or detonator 3, the housing 4 of which is in an electrically conductive connection with the cartridge casing 2, and is also made of metal, preferably brass, as is the cartridge casing 2.

Figure 2:
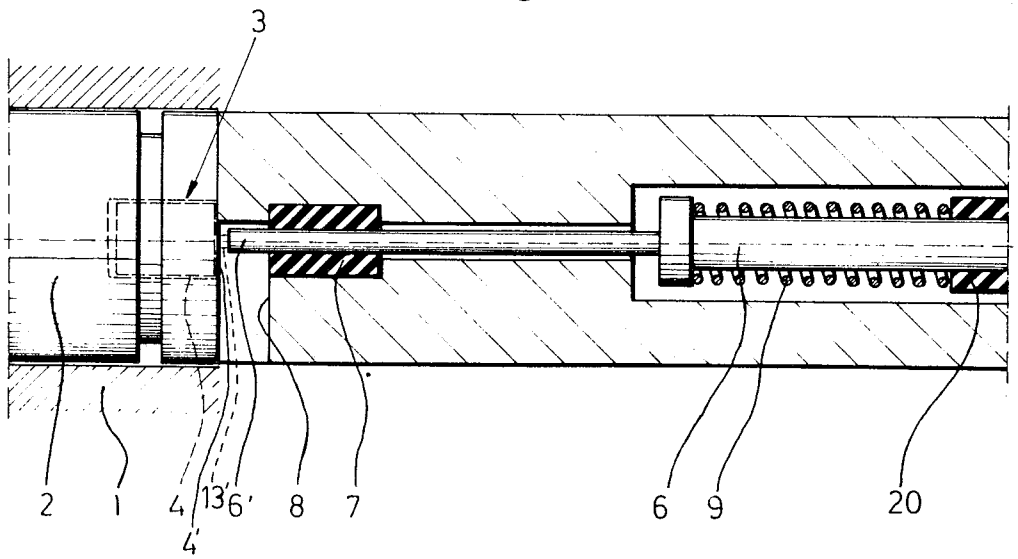
FIG. 2 is a longitudinal schematic cross-section in the region of the breech block, and a fragmentary view of a cartridge abutting the breech block.

In lieu of a striker or firing pin used in a mechanical detonating mechanism, there is provided a rod-shaped detonating current transfer means or element 6, which is longitudinally guidable in a manner similar to that of a firing pin. An end segment of the detonating current transfer element 6 facing the cartridge casing 2 is implemented as an also cylindrically shaped ignition tip 6' having a diameter smaller than that of the detonating current transfer element 6. As shown in FIG. 2, the free end segment of the ignition tip 6' is longitudinally guidable in a sleeve-like insulator 7, which is inserted into a bore of the breech block 8 concentric with the ignition tip 6', the insulator 7 being of ceramic material, namely of a very hard material. A portion of the breech block 8 projects slightly beyond the front face of the insulator 7 facing the cartridge case 2. The portion of the detonating current transfer element 6 having the larger diameter is surrounded by a helical spring 9, which abuts on one hand a collar of that larger diameter portion of the detonating current transfer element, and abuts, on the other hand, a guidance body 20 surrounding that larger diameter portion in a tube-like manner. The spring 9 is dimensioned so that the ignition tip 6' exerts a contact force of about 10 g onto the floor portion 4' of the detonator housing 4 of the detonator 3.

As shown in FIG. 1, the portion of the detonation current circuit connected to the battery 5 includes the detonating current transfer element 6, the cartridge chamber 1, as well as a thyristor 11, all the aforementioned elements being connected in series. This portion of the detonating current circuit also includes the cartridge, the casing of which is electrically connected to the cartridge chamber, the detonator housing 4, which is electrically connected to the casing, being in turn contactable by the ignition tip 6'. In parallel with the circuit formed by the detonating current transfer element 6, the cartridge chamber 1, and the thyristor 11, there is connected a source of detonating current 12, as well as discharge circuit including a resistor 13 and a manually actuatable switch 14 connected in series, the detonating current source 12 being dischargeable by the discharge circuit. The detonating current source 12 may consist, as shown in FIG. 1, of several capacitors, for example capacitors $C_1$, $C_2$, and $C_3$ connected in parallel, which may be connected to the battery 5 through respective manually actuatable switches $S_1$, $S_2$, and $S_3$. The capacitors of the detonator current source are preferably implemented as high-grade electrolytic capacitors, so as attain an impulse-like discharge at a high current strength, which may be in the region of 30 A.

A detonating circuit 15 is connected to the battery 5, which can be actuated by means of a manually actuatable opening switch 16. The output of the detonating circuit 15 is connected through a manually actuatable security switch 17 to the trigger electrode of the thyristor 11. If the security switch 17 is closed, then actuation of the opening switch 16 causes the thyristor 11 to conduct. If a cartridge is disposed in the cartridge chamber 1, the detonating current effects the detonation of the detonating means in the detonator and thereby the detonation of the propelling charge in the cartridge by sufficient heat being developed across a transition resistance arising and becoming effective between the ignition tip 6' and the floor 4' portion of the detonator housing 4 during contact establishment between the ignition tip 6' and the floor portion 4', so that the detonating means disposed in the detonator housing is heated at least to its detonating temperature. For clarity's sake, even though the transition resistance exists only fleetingly, it is shown and denoted in FIG. 2 by the reference numeral 13'. The thyristor is connected in such a way into the detonating current circuit, so that the flowing detonating current effects a migration or, transport of the brass evaporating from the floor portion of the detonator housing 4 towards the ignition tip 6'.

A quenching circuit 18 is provided to render the thyristor 11 non-conductive, following its activation; the output of the quenching circuit 18 is connected to the trigger electrode of the thyristor 11, while its input is connected to the battery 5. As has already been mentioned, the quenching circuit 18 therefore returns the thyristor 11 again to a non-conducting state.

Switching-in and switching-out of the entire detonating mechanism is accomplished by means of a manually actuatable switch 19 connected in one of the two leads leading to the battery 5.

It will be appreciated that numerous variations and modifications may be made in the detonating mechanism, according to the present invention, by anyone skilled in the art, in accordance with the principles of the invention hereinabove set forth, and without the exercise of any inventive ingenuity. It should furthermore be noted that all features ascertainable from the description and from the appended drawing form part of the invention, even though they may not be highlighted in particular, or be mentioned in the claims.

I claim:

1. A detonator mechanism for cartridges, particularly cartridges for use in a manually actuatable weapon, and normally actuatable by a firing pin, each cartridge including a casing having at least a partial region which is electrically conductive, and a detonator with an electrically conductive detonator housing, including a floor portion, said detonator housing containing detonating means ignitable above a predetermined detonating temperature, a portion of said weapon being adapted to contain at least one of said cartridges, and being electrically connected to said conductive region of said casing, comprising, in combination, detonating current transfer means made of an electrically conductive material, being movably supported with respect to said floor portion, and being arranged to establish a contact with said floor portion, there being formed external of said detonator housing a transition resistance between said floor portion and said detonating current transfer means during said contact establishment, at least one rechargeable capacitor serving as a source of detonating current, said source of detonating current, said detonating current transfer means, said detonator, said casing, and said portion of said weapon forming a series-connected circuit, a switch connected in said circuit for the activation thereof, said detonator housing being free of any resistive element disposed therein which is proximate to said detonating means, said detonating current and said transfer resistance being selected so that heat generated by said detonating current in said transfer resistance is sufficient to heat said detonating means at least up to said detonating temperature.

2. The detonator mechanism as claimed in claim 1, wherein said rechargeable capacitor is adapted to be connected to a voltage source for being charged at a predetermined polarity, whereby said detonating current in passing between said detonator and said detonating current transfer means causes a metal deposition to take place on said detonating current transfer means.

3. The detonator mechanism as claimed in claim 1, wherein said switch includes a semiconductor.

4. The detonator mechanism as claimed in claim 3, wherein said semiconductor is a thyristor.

5. The detonator mechanism as claimed in claim 1, wherein said detonating current transfer means includes a rod formed with an ignition tip arranged to make contact with said floor portion, said ignition tip having a diameter ranging from 0.5 mm to 1.5 mm.

6. The detonator mechanism as claimed in claim 5, wherein said diameter is about 1.3 mm.

7. The detonator mechanism as claimed in claim 1, wherein said detonating current transfer means has an end region arranged to make contact with said floor portion, and wherein at least said end region is made of a tough and fire resistant-material.

8. The detonator mechanism as claimed in claim 7, wherein said tough and fire-resistant material is selected from the group consisting of pure iron, steel, tungsten, tantalum, and copper-tungsten.

9. The detonator mechanism as claimed in claim 1, further comprising at least one spring exerting through said detonating current transfer means a predetermined contact pressure onto said floor portion, and wherein said predetermined pressure lies in the range from 2 g to 20 g.

10. The detonator mechanism as claimed in claim 9, wherein said predetermined pressure is 5 g.

11. The detonator mechanism as claimed in claim 1, wherein said weapon includes a breech block having a metallic part, and containing insulating means made of a hard material, said insulating means being inserted into said breech block, said detonating current transfer means being insulated from said metallic part by said insulating means.

12. The detonator mechanism as claimed in claim 11, wherein said hard material is selected from a group consisting of a ceramic material and of corundum.

* * * * *